US010605035B2

(12) United States Patent
Shampine et al.

(10) Patent No.: US 10,605,035 B2
(45) Date of Patent: Mar. 31, 2020

(54) INVERTED PIPE RAM PROTECTION SYSTEM

(71) Applicant: SCHLUMBERGER TECHNOLOGY CORPORATION, Sugar Land, TX (US)

(72) Inventors: Rod Shampine, Houston, TX (US); Idalia Ovalle Stevenson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 353 days.

(21) Appl. No.: 15/275,737

(22) Filed: Sep. 26, 2016

(65) Prior Publication Data

US 2018/0087341 A1 Mar. 29, 2018

(51) Int. Cl.
*E21B 33/06* (2006.01)

(52) U.S. Cl.
CPC ..... *E21B 33/062* (2013.01)

(58) Field of Classification Search
CPC ..... E21B 33/04; E21B 33/06; E21B 33/061; E21B 33/062; E21B 33/063; E21B 19/22; E21B 34/02
See application file for complete search history.

(56) References Cited

U.S. PATENT DOCUMENTS 4,383,436 A * 5/1983 Hailey ..... E21B 33/062 73/46
4,938,290 A * 7/1990 Leggett ..... E21B 33/062 166/387
6,209,652 B1 * 4/2001 Portman ..... E21B 19/22 166/379

FOREIGN PATENT DOCUMENTS

WO 2016130612 A1 8/2016

* cited by examiner

*Primary Examiner* — David Carroll
(74) *Attorney, Agent, or Firm* — Cathy Hewitt

(57) ABSTRACT

A blow out preventer includes a blow out preventer body, at least one pipe ram disposed in the blow out preventer body which opens or closes in at least one respective cavity defined by the blow out preventer body, an inverted pipe ram disposed in the blow out preventer body which opens or closes in a respective cavity defined by the blow out preventer body, and a pressure management system for adjusting pressure within the blow out preventer below damaging pressure levels as one or more of the at least one pipe ram and the inverted pipe ram open or close in a respective cavity. In some cases, a second pipe ram disposed in the blow out preventer body which opens or closes in a respective cavity defined by the blow out preventer body.

12 Claims, 3 Drawing Sheets

INVERTED PIPE RAM PROTECTION SYSTEM

FIELD

The field to which the disclosure generally relates to wellsite equipment such as oilfield surface equipment, downhole assemblies, coiled tubing (CT) assemblies, and the like.

BACKGROUND

This section provides background information to facilitate a better understanding of the various aspects of the disclosure. It should be understood that the statements in this section of this document are to be read in this light, and not as admissions of prior art.

Coiled tubing is a technology that has been expanding its range of application since its introduction to the oil industry in the 1960's. Its ability to pass through completion tubulars and the wide array of tools and technologies that can be used in conjunction with it make it a very versatile technology.

In coiled tubing operations, the process whereby downhole tools are transferred from atmospheric pressure to wellbore pressure is called deployment. Most coiled tubing deployment is done using a riser long enough that the entire tool may be placed inside it at once, and then pressurized. However, for longer tools this is not feasible due to limitations on the maximum height for a coiled tubing injector. Charge pressure and crane availability may also present issues.

In such cases where longer tools are used, the tools are lowered into the well in sections and hung off of blow out preventer (BOP) rams using a deployment bar that matches the diameter of the coiled tubing. These sections are always placed in a riser and may be conveyed in by coiled tubing, wireline, or slickline. Failures are known to occur in this process when the precise order of steps is not followed. Failure usually consists of ejecting either wellbore fluids and/or the tool itself. This sort of failure is catastrophic, but it is usually possible to close the well in quickly using the BOP.

Inverted rams in BOPs are commonly used in wireline operations, and are most often used to contain grease injection between an inverted and regular wireline ram. The grease serves to seal the spaces present in armor wire strands of the wireline cable. These rams are also occasionally used to facilitate pressure testing by providing a way to deliver high pressure from the bottom of a BOP, independent of the well bore pressure. However, these rams add significant hazards when used, as they create a sealed cavity in the wellbore system above the BOP rams. If a ram is opened or closed in this cavity, the cavity pressure will either rise to dangerous levels or fall below well bore pressure which may lead to damage of the inverted ram or to the BOP itself.

One approach to obviate the above problems has been to protect inverted rams using a check valve incorporated in the BOP ram body to prevent reverse pressurization. However, this approach has not proven to be reliable.

Hence, it remains desirable to provide improvements in blow out preventer related equipment to protect internal rams and manage wellbore pressure, and the embodiments disclosed herein provide, at least in part, such improvement.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In a first aspect of the disclosure, a blow out preventer is provided which includes a blow out preventer body, at least one pipe ram disposed in the blow out preventer body which opens or closes in at least one respective cavity defined by the blow out preventer body, an inverted pipe ram disposed in the blow out preventer body which opens or closes in a respective cavity defined by the blow out preventer body, and a pressure management system for adjusting pressure within the blow out preventer below damaging pressure levels as one or more of the at least one pipe ram and the inverted pipe ram open or close in a respective cavity. In some cases, a second pipe ram disposed in the blow out preventer body which opens or closes in a respective cavity defined by the blow out preventer body. The pressure management system may decrease pressure as the at least one pipe ram closes in at least one respective cavity, and in some aspects, the pressure management system decreases pressure as the at least one pipe ram and the inverted pipe ram close in respective cavities. The pressure management system may also prevent pressure loss as the at least one pipe ram opens in at least one respective cavity.

In some embodiments, the pressure management system is an external equalizing valve manifold. The external equalizing valve manifold may include an equalizing valve and dual check valves. In some cases, the external equalizing valve manifold contains a valve which senses pressure in one or more cavities defined by the blow out preventer, and compares the pressure to atmospheric pressure. Pressure in the one or more cavities may also be adjusted after comparison to atmospheric pressure by fluidly connecting the one or more cavities. The external equalizing valve manifold may include a valve which is locked out during pressure testing.

In some aspects, the pressure management system includes one or more control valves disposed in hydraulic oil control pathways in fluid communication with control cylinders for opening or closing the at least one pipe ram and the inverted pipe ram, and further, the one or more control valves and fluid in the hydraulic oil control pathways may prevent damaging pressure levels as one or more of the at least one pipe ram and the inverted pipe ram open or close in a respective cavity.

In another aspect of the disclosure, a coiled tubing deployment system includes a blow out preventer having a blow out preventer body, at least one pipe ram disposed in the blow out preventer body which opens or closes in at least one respective cavity defined by the blow out preventer body, an inverted pipe ram disposed in the blow out preventer body which opens or closes in a respective cavity defined by the blow out preventer body, a pressure management system for adjusting pressure within the blow out preventer below damaging pressure levels as one or more of the at least one pipe ram and the inverted pipe ram open or close in a respective cavity, and a tool string disposed in the blow out preventer. A second pipe ram may be disposed in the blow out preventer body which opens or closes in a respective cavity defined by the blow out preventer body.

In some aspects, the pressure management system decreases pressure as the at least one pipe ram closes in at least one respective cavity. The pressure management system may also decrease pressure as the at least one pipe ram and the inverted pipe ram close in respective cavities. In some other aspects, the pressure management system increases pressure as the at least one pipe ram opens in at least one respective cavity. Also, the pressure management may be an external equalizing valve manifold, one or more control valves disposed in hydraulic oil control pathways in fluid communication with control cylinders for opening or closing the at least one pipe ram and the inverted pipe ram, or a combination of both.

Yet another aspect provides a method of conveying a coiled tubing tool string into a wellbore, which involves providing a blow out preventer having a blow out preventer body. The blow out preventer includes at least one pipe ram disposed in the blow out preventer body which opens or closes in at least one respective cavity defined by the blow out preventer body, an inverted pipe ram disposed in the blow out preventer body which opens or closes in a respective cavity defined by the blow out preventer body, and a pressure management system for adjusting pressure within the blow out preventer below damaging pressure levels as one or more of the at least one pipe ram and the inverted pipe ram open or close in a respective cavity. A first portion of a coiled tubing tool string is placed in the blow out preventer, and sealing the coiled tubing tool string is effected by closing the one of the at least one pipe ram and the inverted pipe ram. A second portion of the coiled tubing tool string is attached to the first portion. At least one of the pipe ram and the inverted pipe ram are opened, and the coiled tubing tool string conveyed into the wellbore.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

The following description of the variations is merely illustrative in nature and is in no way intended to limit the scope of the disclosure, its application, or uses. The description and examples are presented herein solely for the purpose of illustrating the various embodiments of the disclosure and should not be construed as a limitation to the scope and applicability of the disclosure.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Embodiments of the disclosure relate to features which significantly reduce the likelihood of damaging the BOP during coiled tubing or wireline deployment operations where an inverted pipe ram is contained within the BOP. In some embodiments an external equalizing valve manifold is connected with the BOP to provide protection during deployment, and in some other embodiments, a valve is used to sense the pressure in a BOP cavity, compare the pressure to atmospheric pressure, and opens to relieve any excess pressure across the BOP ram. A combination of both of these aspects may be used in some cases, as well.

Figure 1:
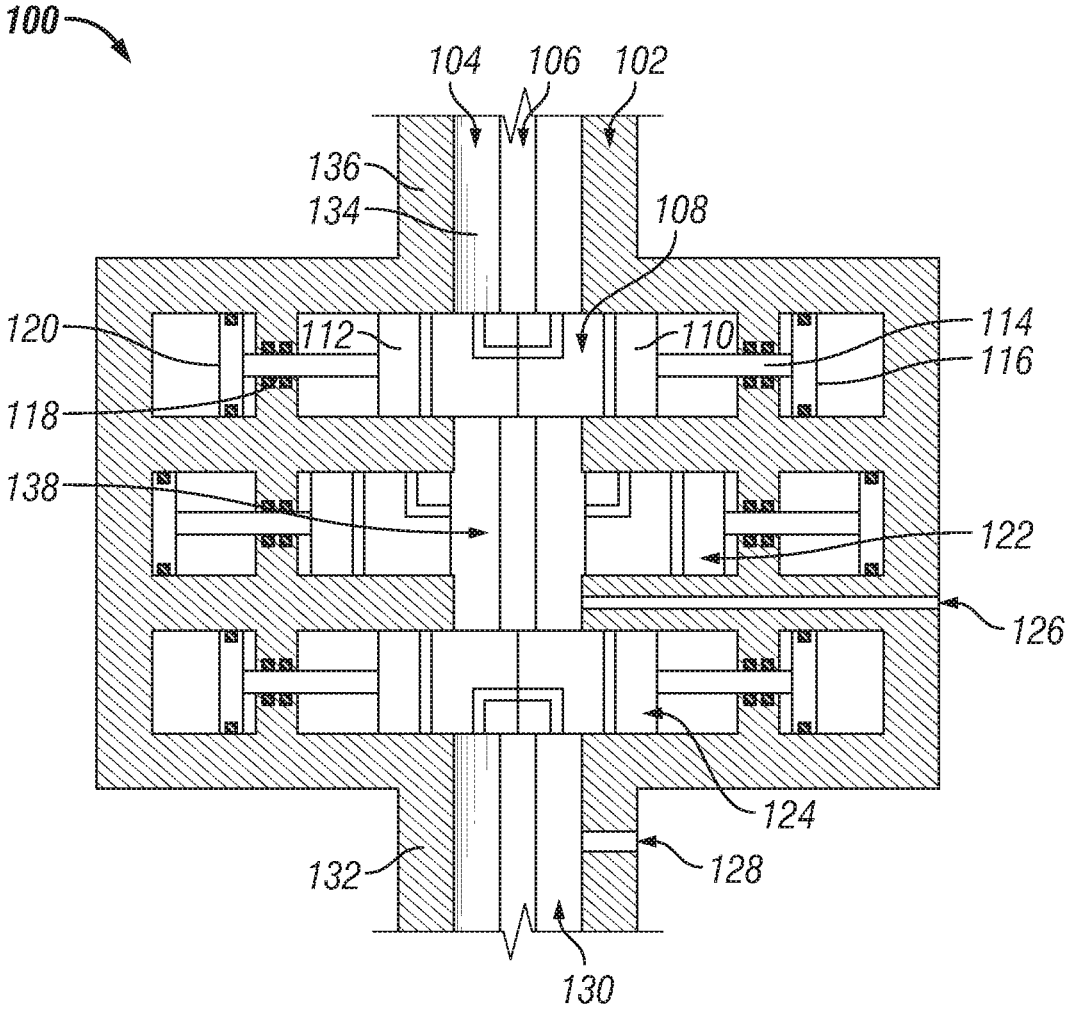
FIG. 1 illustrates a blow out preventer in accordance with an aspect of the disclosure, in a cross-sectional view.

FIG. 1 illustrates a blow out preventer (BOP) in a cross-sectional view. The BOP 100 includes a body 102 which defines a passageway 104 through which a wireline, tubular or tool 106 may pass through. An upper pipe ram 108, shown closed position, is included in the BOP 100. Upper pipe ram 108 has two halves, 110 and 112, driven by rods 114, 118, and pistons 116, 120. A lower pipe ram 122, shown in an open position is also formed of halves and driven by a like set of rods and pistons. The system further includes inverted pipe ram 124, shown in a closed position, which is also formed of halves and driven by a like set of rods and pistons. A port 126 is disposed through body 102 between the lower pipe ram 122 and the inverted pipe ram 124. A second port 128 is disposed through body 102 below the inverted pipe ram 124. Cavity 130 is the annulus formed between the wireline, tubular or tool 106 and lower region 132 of the BOP 100, and cavity 134 is the annulus formed in the upper region 136 of BOP 100. Cavity 138 is the annular space between the upper pipe ram 108 and the inverted pipe ram 124, which may be bisected by lower pipe ram 122.

In operation, as the lower pipe ram 122 of BOP 100 is closed, the pressure in cavity 138 will rise, and in most cases to destructive pressure levels, due to the volume displacement of the ram 122 when driven by the piston/rod arrangement. Another failure which may occur is after all three rams are closed, and then lower pipe ram 122 is opened, pressure in cavity 138 may decrease below the pressure in either cavity 130 or 134. This may lead to leakage across, or failure of, seals present in pipe ram 108 and/or inverted pipe ram 124. Embodiments according to the disclosure serve, at least in part, to obviate the potential pressure damage when lower pipe ram 122 is opened, closed, or both.

Figure 2:
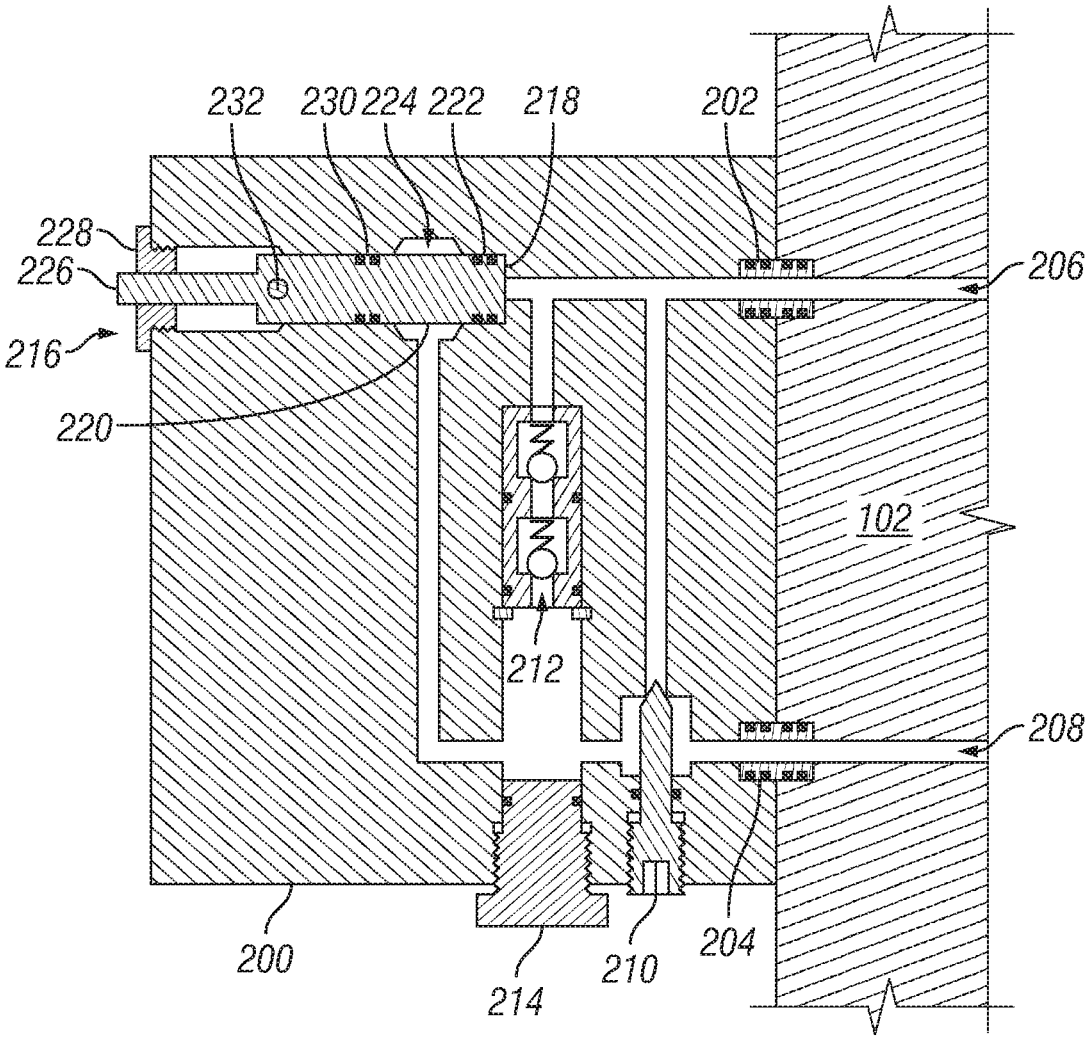
FIG. 2 depicts an external equalizing valve manifold in accordance with the disclosure, in a cross-sectional view; and, FIG. 3 shows a system to protect blow out preventer pipe rams in accordance with some aspects of the disclosure, in a cross-sectional view.

Now referencing FIG. 2, which depicts an external equalizing valve manifold in a cross-sectional view. External equalizing valve manifold 200 is shown attached to BOP body 102. Equalizing valve manifold 200 includes port bushings 202 and 204 for sealing ports 206 and 208 extending through equalizing valve manifold 200 manifold and BOP body 102. Port 206 may lead to port 126 shown in FIG. 1, and port 208 may lead to port 128 shown in FIG. 1. Equalizing valve 210 may be incorporated to relieve the pressure differential across inverted pipe ram 122 in FIG. 1.

External equalizing valve manifold 200 further includes dual check valves 212 positioned such that reverse pressure across the inverted pipe ram 122 will be relieved by flow through dual check valves 212. Said dual check valves 212 may also be provided with one or two isolation valves to either allow the passage to be sealed in the case of failure of both valves, or to allow the dual check valves 212 to be replaced while the BOP 100 is in service. Needle and seat valves such as shown at 210 would be suitable for this service, and would be added to the passage leading from each side of the check valves 212 to the well bore passages 206 and 208. It would be acceptable to have valves to close off at the port bushings 202 and 204 for this service operation. In the latter case, a bleed valve would be provided in place of a plug, which is shown as 214.

Another aspect according to the disclosure is incorporation of a valve designed to sense the pressure in a BOP cavity, such as sensing pressure through port 126 above, and this pressure is compared to atmospheric pressure. When a selected pressure value is reached, the valve opens and relieves the excess pressure. A benefit of this aspect is that relief of this elevated pressure occurs across the inverted pipe ram, rather than exhausting to atmosphere, since such an atmospheric opening would negate the function of the BOP. However, because the inverted pipe ram is not a well control barrier, disabling it does not create a hazard. Positive pressure testing of rams in the operating direction is degraded by use of such a pressure relieving valve; but the positive pressure testing function may be substituted by bleed off pressure testing (or negative pressure testing) with the cost of additional time. Such a tradeoff is well worth eliminating life-threatening damage to the BOP body, seals, or well control rams. Careful optimization of the relieving pressure and the shearing element 232 will allow this relief function to happen slightly above the rated working pressure of the BOP (or the highest expected pressure testing pressure), but well below the proof test pressure. In the event of the relief function opening, the BOP would be subject to an appropriate inspection before being placed back in service. Such a pressure choice would not impact the operation or testing of the BOP, but the shearing element may need regular replacement, as it will be subject to as much as about 95% of its shear value regularly.

Referring again to FIG. 2, incorporation of a valve designed to sense the pressure in a BOP cavity and compare to atmospheric pressure is generally shown at 216. An exposed end 218 of a valve spool 220 is provided with seals 222 to isolate pressure within port 206 from the cavity 224 leading to the port 208 having a pressure resident therein. Pressure at end 218 is compared to atmospheric pressure via space around tell-tale rod 226 that leads through access nut 228. Seals 230 separate the BOP 100 internal pressure from atmospheric pressure at all times. Seals 222 move from their sealing bore into cavity 224 to allow connection between ports 206 and 208. A shear pin 232 is incorporated, and is sheared by the force resulting from pressure difference in order for the valve to shift. A single or double shear pin may be used, as well as a system incorporating multiple shear pins to allow easy tuning of the shear pressure. The spacing between the shearing bore in manifold 200 and the outer diameter of the valve body 220 is used to control of the pressure that is required to cut or shear pin 232; however, a large spacing may lead to bending rather than shear. Further, the material properties of the shear pin 232 are selected to achieve a controlled shear pressure. The shear element may be round, square, or other shape to ease the manufacturing of these pins, though round may be typically employed.

In accordance with the disclosure, other valve arrangements to accomplish the same result, such as re-seating relief type valves or spring loaded valves will be able to deliver the desired function of preventing over-pressure of the BOP internal components by permanently or temporarily disabling the function of the inverted pipe ram. Such valves may offer the ability to re-seat after functioning, and lessen the difficulties with respect to having the operation pressure close to the pressure test pressure.

Further, the pressure protection valve arrangement may be provided with a safety lockout that is engaged to prevent the operation of the valve while pressure testing. Such a lockout, in some cases, is equipped with a feature to allow easy visual identification of the locked out state.

Figure 3:
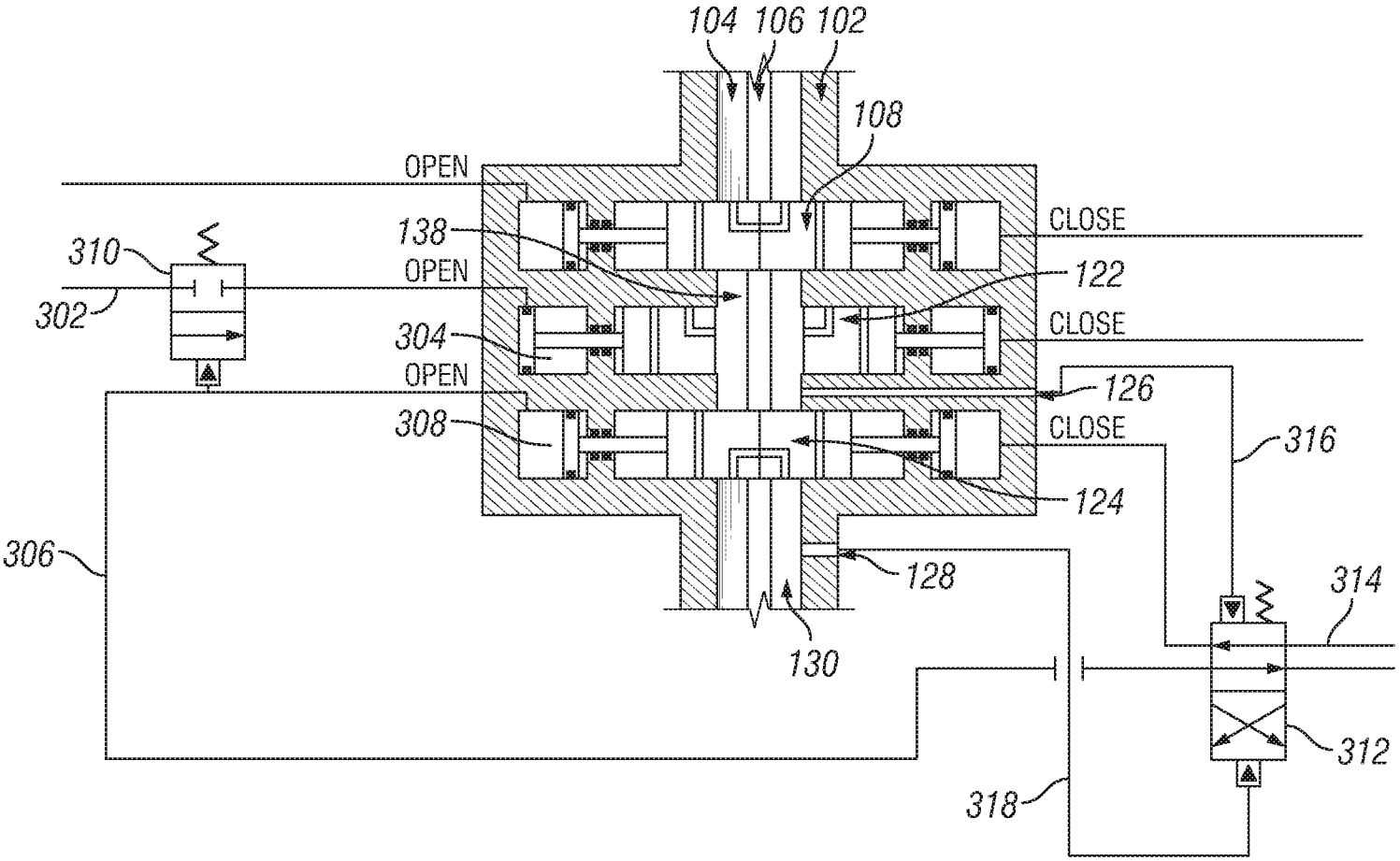

In another embodiment of the disclosure, a method and system to protect BOP pipe rams 108, 122, and inverted pipe ram 124, shown in FIG. 1, from damage is provided by incorporating directional control valves in hydraulic oil control pathways. As depicted in FIG. 3, the pipe rams 108, 122 and 124 are opened or closed by pressurizing either the hydraulic oil lines labeled as "open" or "close" as shown in FIG. 3. For example, hydraulic line 302 pressurizes fluid present in cylinder 304 to open pipe ram 122, and hydraulic line 306 independently pressurizes to open inverted pipe ram 124. A two position, spring return and pilot operated control valve 310 can be placed along the flow path of hydraulic line 302 in such way that hydraulic line 302 does not have fluid communication unless there is hydraulic pressure on hydraulic line 306. Hydraulic pressure on hydraulic line 306 shifts valve 310 through the pilot to allow fluid communication through hydraulic line 302 and thus allowing the opening of pipe ram 122. In such way, pipe ram 122 can only be operated if the inverted pipe ram 124 is open, thus preventing damage to the pipe rams.

In some cases, damage to inverted pipe ram 124 could also occur by the pressure in cavity 130 exceeding the pressure in cavity 138 by a known "pressure differential limit", typically about 1800 psi. This damage can be prevented by placing a two position, spring return and pilot operated control valve 312 on hydraulic oil line 314 for opening or closing pipe ram 124. The spring can be sized such that it keeps valve 312 in the position shown, with fluid communication on line 314, unless the pressure in cavity 130 increases above the pressure in cavity 138 by the known "pressure differential limit". Valve 312 senses the pressure differential through the pilot communicated to line 316, port 126 and cavity 138, and through the pilot communicated to line 318, port 128 and cavity 130. When the pressure in cavity 130 exceeds the pressure in cavity 138 by the "pressure differential limit", valve 312 shifts, allowing pressure from line 314 to communicate to line 306, thus opening the inverted pipe ram 124 and preventing damage to it before the "pressure differential limit" is exceeded.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described.

The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A blow out preventer comprising:

a blow out preventer body;

at least one pipe ram disposed in the blow out preventer body which opens or closes in at least one respective cavity defined by the blow out preventer body;

an inverted pipe ram disposed in the blow out preventer body which opens or closes in a respective cavity defined by the blow out preventer body, the inverted pipe ram and the at least one pipe ram defining, when respectively closed, a pressure cavity therebetween; and a pressure management system in fluid communication with at least one cavity for adjusting pressure within the pressure cavity below damaging pressure levels, wherein the pressure management system comprises an external equalizing valve manifold and wherein the external equalizing valve manifold comprises an equalizing valve and dual check valves.

2. The blow out preventer of claim 1 further comprising at least a second pipe ram disposed in the blow out preventer body which opens or closes in a respective cavity defined by the blow out preventer body.

3. The blow out preventer of claim 1, wherein the pressure management system is configured to decrease pressure as the at least one pipe ram closes in at least one respective cavity.

4. The blow out preventer of claim 1, wherein the pressure management system is configured to decrease pressure as the at least one pipe ram and the inverted pipe ram close in respective cavities.

5. The blow out preventer of claim 1, wherein the pressure management system is configured to prevent pressure loss as the at least one pipe ram opens in at least one respective cavity.

6. The blow out preventer of claim 1, wherein the external equalizing valve manifold comprises a valve which senses pressure in one or more cavities defined by the blow out preventer, and compares the pressure to atmospheric pressure.

7. The blow out preventer of claim 6, wherein the external equalizing valve is configured to adjust pressure in the one or more cavities after comparison to atmospheric pressure by fluidly connecting the one or more cavities.

8. The blow out preventer of claim 1, wherein the external equalizing valve manifold comprises a valve which is locked out during pressure testing.

9. The blow out preventer of claim 1, wherein the pressure management system comprises one or more control valves disposed in hydraulic oil control pathways in fluid communication with control cylinders for opening or closing the at least one pipe ram and the inverted pipe ram.

10. The blow out preventer of claim 9, wherein the one or more control valves and fluid in the hydraulic oil control pathways are configured to prevent damaging pressure levels as one or more of the at least one pipe ram and the inverted pipe ram open or close in a respective cavity.

11. The blow out preventer of claim 1 further comprising a tool string disposed in the blow out preventer.

12. A method of conveying a coiled tubing tool string into a wellbore, the method comprising:

providing a blow out preventer having a blow out preventer body, wherein the blow out preventer comprises:

at least one pipe ram disposed in the blow out preventer body which opens or closes in at least one respective cavity defined by the blow out preventer body;

an inverted pipe ram disposed in the blow out preventer body which opens or closes in a respective cavity defined by the blow out preventer body; and, a pressure management system for adjusting pressure within the blow out preventer below damaging pressure levels as one or more of the at least one pipe ram and the inverted pipe ram open or close in a respective cavity;

placing a first portion of a coiled tubing tool string in the blow out preventer, and sealing the coiled tubing tool string by closing the one of the at least one pipe ram and the inverted pipe ram;

attaching a second portion of the coiled tubing tool string to the first portion;

pressure testing the blow out preventer and, in the event of an elevated pressure, utilizing the pressure management system to relieve pressure across the inverted pipe ram; and opening, if the pressure management system has not relieved the pressure across the inverted pipe ram, at least one pipe ram and the inverted pipe ram, and conveying the coiled tubing tool string into the wellbore.

* * * * *